US005311817A

United States Patent [19]

Funada

[11] Patent Number: 5,311,817

[45] Date of Patent: May 17, 1994

[54] PRINTING PRESSURE ADJUSTING APPARATUS OF PRINTING CYLINDERS

[75] Inventor: Hitoshi Funada, Sekiyadomachi, Japan

[73] Assignee: Komori Corporation, Tokyo, Japan

[21] Appl. No.: 882,446

[22] Filed: May 12, 1992

[30] Foreign Application Priority Data

May 15, 1991 [JP] Japan ..... 3-034157[U]

[51] Int. Cl.[5] ..... B41F 5/18

[52] U.S. Cl. ..... 101/177; 101/182; 101/216; 101/247; 101/218

[58] Field of Search ..... 101/139, 137, 140, 143, 101/144, 145, 177, 182, 184, 185, 216, 218, 247

[56] References Cited

U.S. PATENT DOCUMENTS

| | | | |
|---|---|---|---|
| 2,855,846 | 10/1958 | Harless et al. | 101/218 |
| 3,072,050 | 1/1963 | Wolff | 101/177 |
| 3,452,672 | 7/1969 | Bolza-Schüngmann | 101/177 |
| 3,769,910 | 11/1973 | Heimlicher et al. | 101/177 |
| 4,218,972 | 8/1980 | Fujishiro | 101/177 |
| 4,369,705 | 1/1983 | Gelinas | 101/247 X |
| 4,458,590 | 7/1984 | Egnaczak et al. | 101/247 |
| 4,640,189 | 2/1987 | Hernandez | 101/182 X |
| 4,643,090 | 2/1987 | McKrell et al. | 101/218 |

FOREIGN PATENT DOCUMENTS

| | | | |
|---|---|---|---|
| 1156928 | 11/1966 | United Kingdom | 101/218 |

*Primary Examiner*—Edgar S. Burr
*Assistant Examiner*—Christopher A. Bennett
*Attorney, Agent, or Firm*—Abelman Frayne & Schwab

[57] ABSTRACT

When a screw 60 has been adjusted, a printing pressure adjusting disc 72 is turned through a shaft 75 and a segment gear 73 to adjust an eccentric pin through a link 78 and a lever 79. Also when the amount of eccentricity of a rubber cylinder 53 has been changed as a result of the adjustment of the stopper screw 60, the eccentric pin of each plate cylinder also is simultaneously adjusted in accordance with the amount of adjustment of the screw 60, and further the amount of eccentricity of the plate cylinder is changed to such a state that a printing pressure is kept constant in relation to the rubber cylinder 53, thus enabling the printing pressure adjustment with little labor and time to thereby improve printing operation performance.

4 Claims, 6 Drawing Sheets

PRINTING PRESSURE ADJUSTING APPARATUS OF PRINTING CYLINDERS

BACKGROUND OF THE INVENTION

1. Field of the Utilization

The present invention relates to an apparatus which adjusts the printing pressure of printing cylinders for the purpose of improving operation performance.

2. Description of the Prior Art

As a printing press for printing bank notes and other securities, a satellite-type printing press for simultaneous multicolor printing has been known. In this printing press, a plurality of plate cylinders are arranged in a satellite form around a single gathering rubber cylinder, and the multicolor printing is performed at the same time by applying the printing pressure while feeding printing paper in between an impression cylinder or a rubber blanket cylinder revolving in contact with the gathering rubber cylinder. The printing press of this type is capable of obtaining printed matter without miss-registering.

FIG. 5 schematically shows the constitution of the satellite-type printing press. On a frame 1 of a printing press body are supported a pair of rubber blanket cylinders 2. Around each of these rubber blanket cylinders 2 are mounted, in a satellite form, a plurality (four in the illustrated example) of plate cylinders 3, which revolve in contact with the rubber blanket cylinders 2. To each of the plate cylinders are connected a plurality of inking arrangements 4, which are mounted to a frame 5 of the inking arrangement unit. These inking arrangements 4 are designed to supply printing ink to the plate cylinders 3.

The sheet is fed from a sheet feeder into a pair of rubber blanket cylinders 3, and is fed out, after printing on both sides thereof, to a delivery apparatus not illustrated.

In the satellite-type printing press shown in FIG. 5, the printing pressure is adjusted so as to be constantly a fixed value by shifting the position of the rubber blanket cylinders 2 in the event that the sheet to be printed has change in thickness. However, when the position of the rubber cylinders 2 is shifted, the printing pressure of both the plate cylinders 3 and the rubber blanket cylinders 2 varies; it is therefore necessary to shift each of the plate cylinders in accordance with the amount of movement of the rubber blanket cylinders 2.

In the following, the movement mechanism of the plate cylinders 3 will be explained by referring to FIG. 6. The plate cylinders 3*a* and 3*b* are supported on both ends by eccentric bearings 4*a* and 4*b*, which are revolvably mounted on the frame. On the eccentric bearings 4*a* and 4*b* are rotatably mounted the plate cylinders 3*a* and 3*b* through bearings which are offset from the center of rotation C-1- of the eccentric bearings 4*a* and 4*b*. The center of rotation C-2- of the plate cylinders 3*a* and 3*b* has an offset position set so that, during the operation of the printing press, a straight line between the center of rotation C-2- of the plate cylinder 3*a* and 3*b* and the center of rotation C-1- of the eccentric bearings 4*a* and 4*b* will meet at right angles with the straight line between the center of rotation not illustrated of the rubber blanket cylinders 2 and the center of rotation C-1- of the eccentric bearings 4*a* and 4*b*.

With the rotation of the eccentric bearings 4*a*, and 4*b* in relation to the frame, the center of rotation C-2- of the plate cylinders 3*a* and 3*b* changes its position, turning around the center of rotation C-1- of the eccentric bearings 4*a* and 4*b* and accordingly enabling the retreat of the plate cylinders 3*a* and 3*b* from the rubber blanket cylinders 2 and printing pressure adjustment.

In the flange section of either of the eccentric bearings 4*a* and 4*b*, a sector gear 16 is fixedly mounted en bloc coaxially with the center of rotation of C-1- of the eccentric bearings 4*a* and 4*b*. The sector gear 16 is in mesh with a sector gear section 17 of a lever 18, which is integrally secured on either end of a connecting shaft 19 which is rotatably mounted through the frame. To the other end of the lever 18 of the connecting shaft 19, the top end section of a piston rod 21 of a fluid pressure cylinder 20*a* and 20*b* pivotally mounted on the frame is connected through a pin 22 to actuate the fluid pressure cylinders 20*a* and 20*b*. Thus the arm 18 rotates together with connecting shaft 19, turning the eccentric sleeves 4*a* and 4*b* through the sector gear section 17 and the sector gear 16. Eccentric cams 25*a* and 25*b* are mounted, facing to the forward end of the piston rods 21 of the fluid pressure cylinders 20*a* and 20*b*. These cams are formed integral with printing pressure adjusting shafts 24*a* and 24*b* supported on the frame in parallel with the center of rotation C-2- of the plate cylinders 3*a* and 3*b* and rotate in contact with the forward end of the piston rods 21, thereby restricting the end of stroke of the fluid pressure cylinder 20*a* and 20*b* in the direction of rotation of the plate cylinders 3*a* and 3*b* which rotate in contact with the rubber blanket cylinder 2.

That is, rotating the printing pressure adjusting shafts 24*a* and 24*b* changes the contact position between each piston rod 21 at one stroke end and the eccentric cams 25*a* and 25*b*, thus restricting the amount of rotation of the lever 18. Consequently the printing pressure of the plate cylinders 3*a* and 3*b* to be applied to the rubber blanket cylinders 2 can be changed.

In the above-described printing press when the rubber cylinder 2 is moved, the eccentric sleeve 4 is rotated to shift the plate cylinder 3 in accordance with the amount of movement of the rubber cylinder 2, thereby keeping a constant printing pressure of the plate cylinders 3 to be applied to the rubber cylinder 2. However, since four plate cylinders 3 are mounted in contact with one rubber cylinder 2, it is necessary to adjust all of the plate cylinders 3 respectively, and in addition the eccentric sleeves 4 must be adjusted on both the control side and the driving side. Therefore, when the sheet thickness of the printing paper has been changed, the adjustment of the eccentric sleeves 4 the same time in accordance with the amount of adjustment of the stop member by means of the interlock mechanism, and the amount of eccentricity of the second cylinder is changed to keep a constant printing pressure between the first and second cylinders.

The present invention and its features and advantages will be set forth and become more apparent in the detailed description of the preferred embodiment presented below, when read in connection with the accompanying drawings.

SUMMARY OF THE INVENTION

The present invention has been accomplished in an attempt to solve the problems mentioned above and has as its object the provision of a printing press having a plurality of second cylinders revolving in contact with one first cylinder, the printing press comprising: eccentric bearings rotatably fitted on the frame of the printing press and rotatably supporting, in an eccentric state, the first cylinder; eccentric sleeves rotatably fitted on the frame of the printing press, in the opposite position of the first cylinder, and rotatably supporting the second cylinders in the eccentric state; a stop member for adjustably restricting the rotational position of the eccentric bearing; a stop member for adjustably restricting the rotational position of the eccentric sleeves; and an interlock mechanism for maintaining a constant state of contact of the first and second cylinders by simultaneously changing the position of restriction of each stop member at the time of bearing adjustment.

Turning the eccentric bearing gives an eccentricity to the first cylinder, and accordingly the eccentric sleeves rotate to turn the second cylinder off-centered, applying the printing pressure to the first and second cylinders. When the amount of eccentricity of the first cylinder has been altered by the adjusting the stop member, the restriction position of each stop member is also adjusted at

DESCRIPTION OF THE PREFERRED EMBODIMENT

Figure 1:
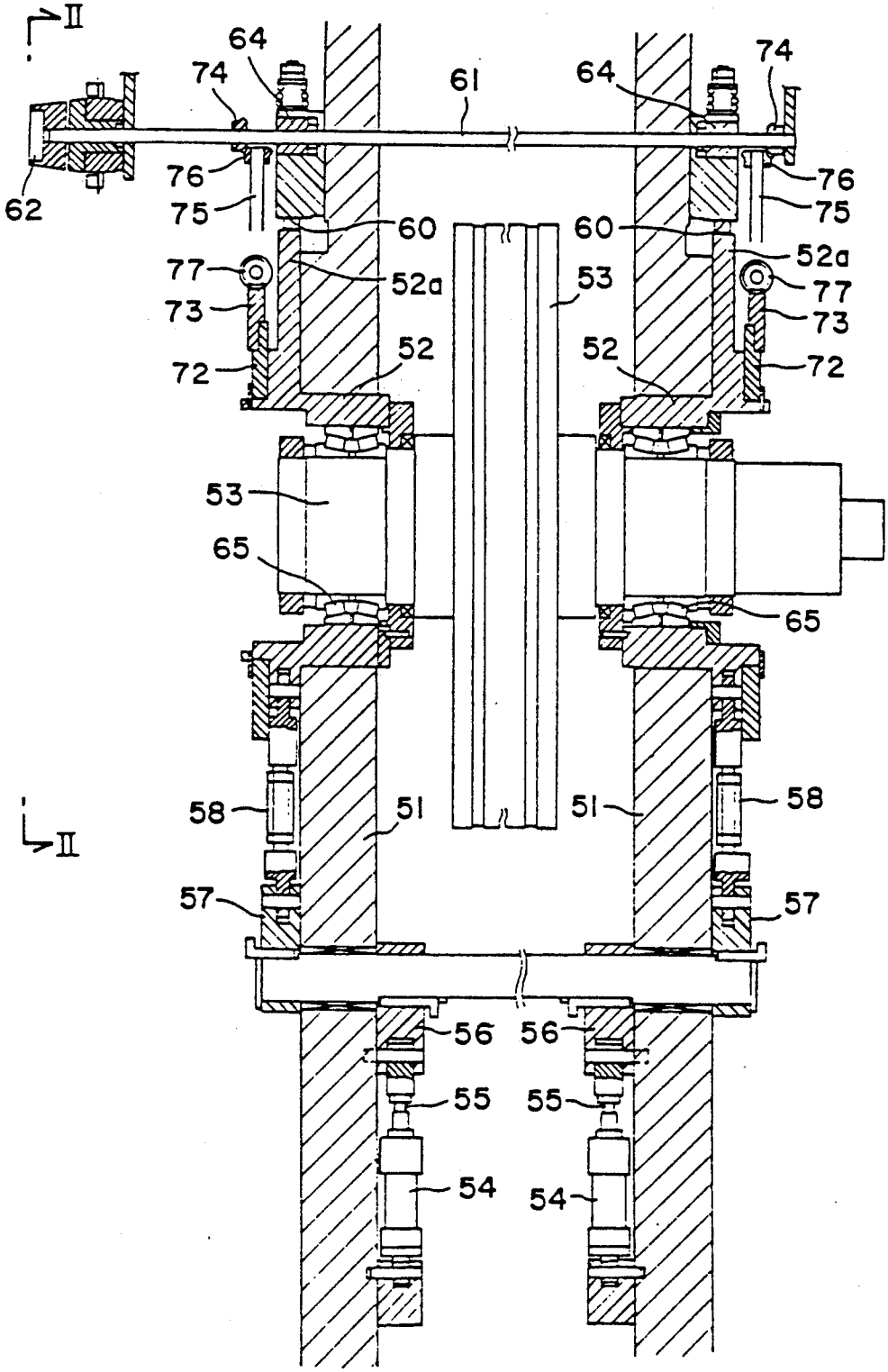
FIG. 1 is an expanded sectional view of a rubber cylinder support section of a printing press equipped with a printing pressure adjusting apparatus according to one embodiment of the present invention.
Figure 2:
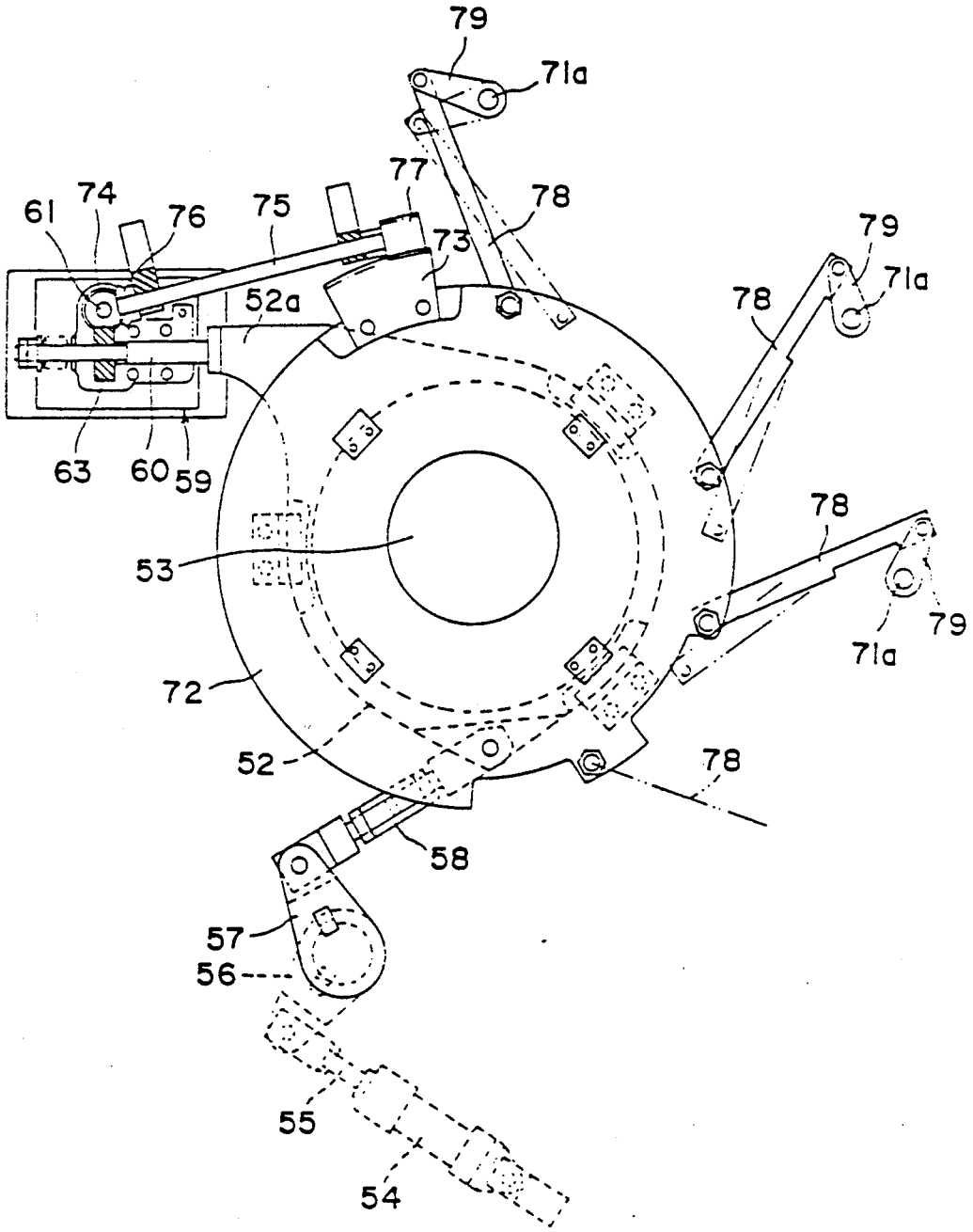
FIG. 2 is a view taken in the direction of the arrows along line II—II in FIG. 1.
Figure 3:
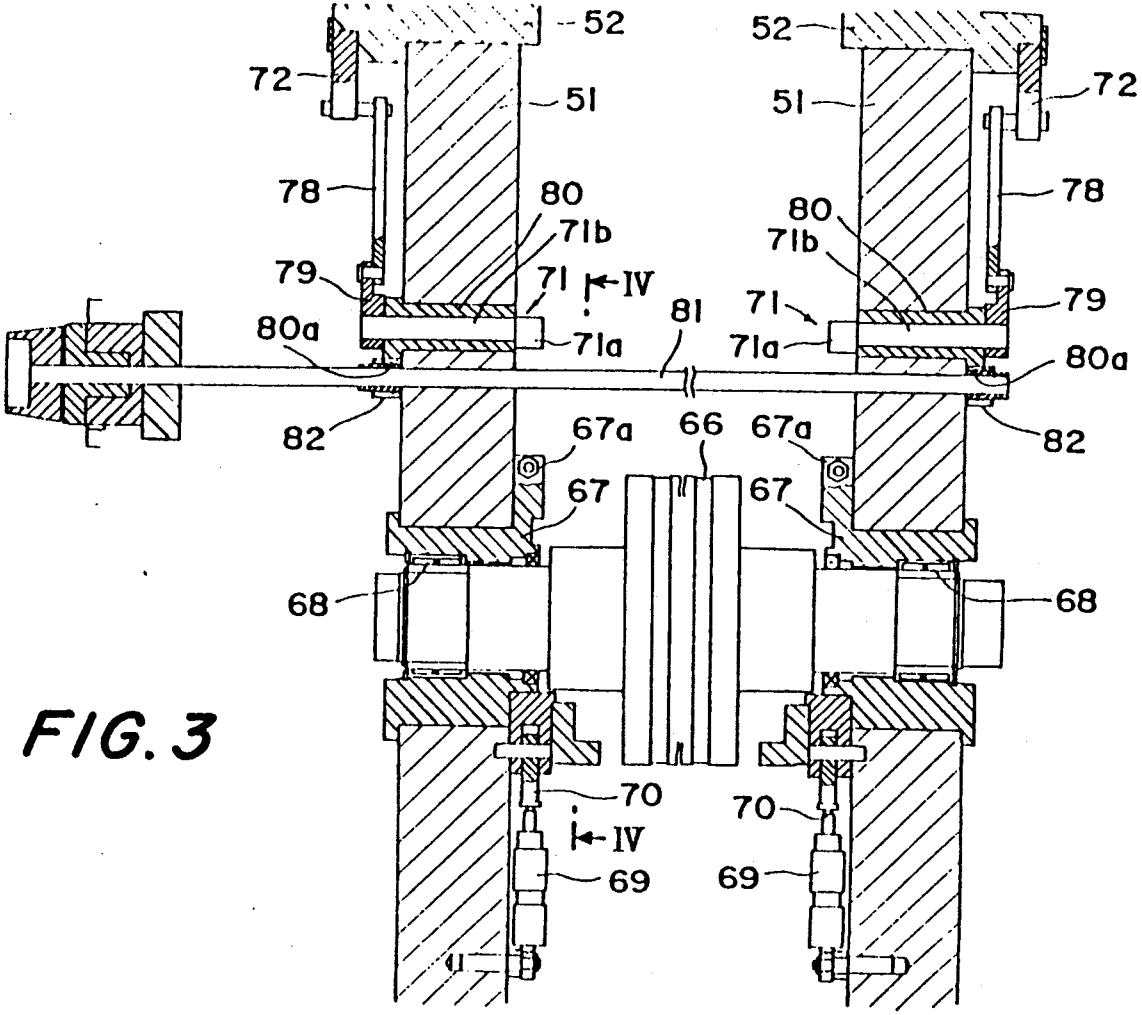
FIG. 3 is an expanded sectional view of a plate cylinder support section.
Figure 4:
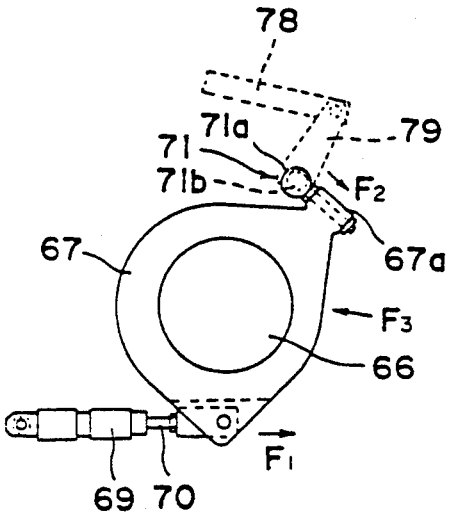
FIG. 4 is a perspective view taken along line IV—IV in FIG. 3.
Figure 5:
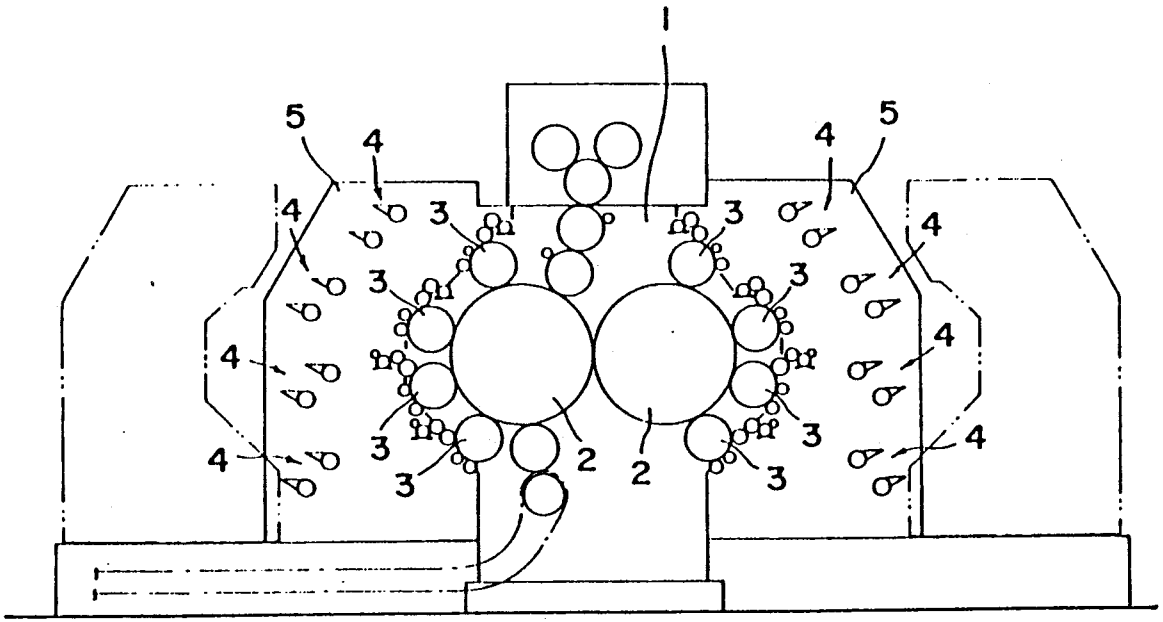
FIG. 5 is a schematic view showing the construction of a satellite-type printing press.
Figure 6:
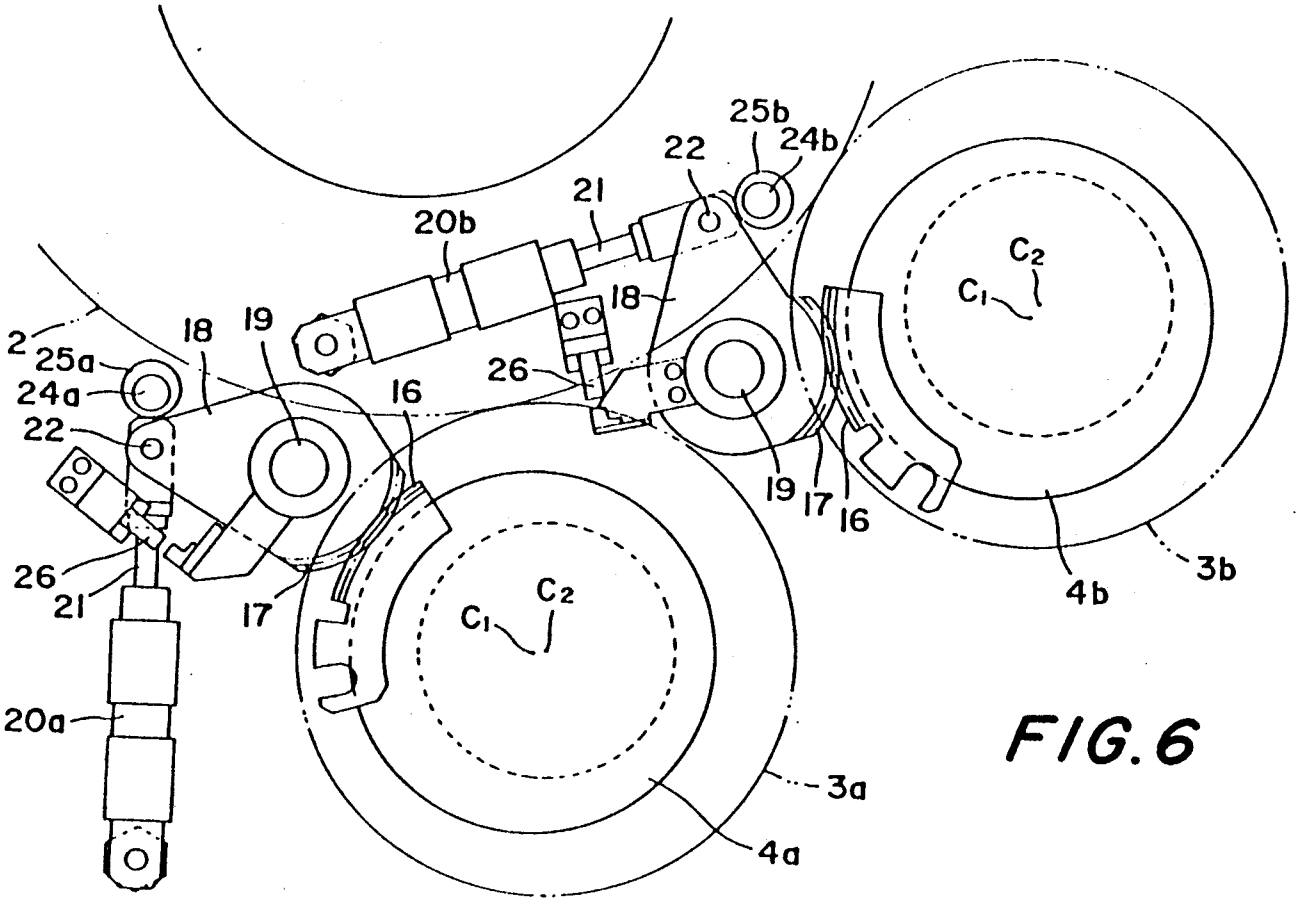
FIG. 6 is a schematic view showing the construction of a conventional printing pressure adjusting apparatus. requires much time and labor.

FIG. 1 is an expanded sectional view of a rubber cylinder support section of a printing press equipped with a printing pressure adjusting apparatus according to one embodiment of the present invention; FIG. 2 is a view taken in the direction of the arrows along line II—II in FIG. 1; FIG. 3 is an expanded sectional view of a plate cylinder support section; and FIG. 4 is a view taken in the direction of the arrows along line IV—IV in FIG. 3.

As shown in FIGS. 1 and 2, an eccentric bearing 52 is rotatably fitted on a frame 51 on each of the control and drive sides of the printing press body. This eccentric bearing 52 rotatably supports a rubber blanket cylinder 53 as a first cylinder through a roller bearing 65. On the frame 52 is mounted a fluid pressure cylinder 54 for turning the eccentric bearing 52. A piston rod 55 of the fluid pressure cylinder 54 is connected to the eccentric bearing 52 through levers 56 and 57 and an adjusting rod 58. Therefore, when the fluid pressure cylinder 54 is driven to expand and contract the piston rod 55, the eccentric bearing 52 is rotated by the levers 56 and 57 and the adjusting rod 58, thus applying printing pressure to the rubber cylinder 53 to perform printing. The amount of rotation of the eccentric bearing 52 is restricted by the contact of the flange section 52*a* with a stop 59, thereby constantly maintaining a fixed printing pressure regardless of the thickness of a sheet.

In the following, the construction of the stop 59 will be explained. The frame 51 is provided with a stop screw 60, which rotates to move in the axial direction toward, or away from, a flange section 52*a* of the eccentric bearings 52. A shaft 61 is installed through the frame 51 on the control side and is rotatable in bearings 64. A handle 62 is mounted on the shaft 61 on the outer side of the frame 51 on the control side. On the stop screw 60 is fixedly mounted a worm gear 63. On the shaft 61 is fixedly mounted a worm gear 74, which is meshed with a the worm gear 63. Turning the handle shaft 62 moves the stop screw 56 in an axial direction by rotation of the worm gears 63 and 74, changing the position of contact of the flange section 52*a* of the eccentric bearing 52 to thereby change the amount of rotation of the eccentric bering 52, and in turn, the position of eccentricity of the rubber blanket cylinder 53.

Around the blanket cylinder 53 are arranged, in a satellite form, a plurality of plate cylinders 66 (FIGS. 3 and 4) as the second cylinders, which rotate in contact with the rubber cylinder 53 and are fed with printing ink from an inking arrangement not illustrated.

Eccentric bearings 67 are revolvably fitted on the frame 51 on both the control and the drive side as shown in FIGS. 3 and 4. These eccentric bearings 67 rotatably support the plate cylinders 66 through a roller bearing 68. A cylinder 69 is mounted on the frame 51, and a piston rod 70 of the cylinder 69 is connected to the eccentric sleeve 67. When the cylinder 69 is driven to actuate the piston rod 70, the eccentric bearing 67 revolves to adjust the printing pressure of the rubber blanket cylinder 53 on the plate cylinder 66. On the opposite side of the connection between the eccentric sleeve 67 and the position rod 70, across the center of revolution, an eccentric cam 71 as a stop is located in contact with a flange section 67*a* of the eccentric bearing 67. The flange section 67*a* contacts the outer periphery of the cam section 71*a* of the eccentric cam 71 to restrict the amount of angular movement of the eccentric bearing 67, consequently enabling adjustment of the printing pressure of the plate cylinder 66 on the rubber cylinder 53. Also since the connection of the piston rod 70 and the contact section of the flange section 67*a* contacting the cam section 71*a* are located opposite sides of the center of rotation of the eccentric sleeve 67, a unidirectional force $F_1$, F2 and its reaction $F_3$ act on the eccentric bearing 67 as shown in FIG. 4 when the piston 70 has been driven to move the eccentric bearing 67 to the end of revolution. Therefore the eccentric bearing 67 is pressed in one direction against the frame 51, leaving no play therebetween.

Next, the construction of the eccentric cam 71 will be explained. As shown in FIG. 3, the eccentric cam 71 consists of a shaft 71*b* and the cam section 71*a* off-centered from the shaft section 71*b* positioned inside of the frame 51. Upon rotation of the shaft section 71*b*, the outer peripheral surface of the cam section 71*a* changes in position relative to the flange section 67*a* of the eccentric bearing 67, thus adjusting the position of contact of the flange section 67*a*, and in turn the amount of rotation of the eccentric bearing 67.

Movement of the stop screw 60, and rotation of each eccentric cam 71 are interlockingly performed by an interlock mechanism which is now explained.

As shown in FIGS. 1 and 2, a printing pressure adjusting disk (hereinafter referred to merely as the disk) 72 is rotatably supported on the eccentric bearing 52.

On the disk 72 is fixed a segment gear 73. On the frame 51 a shaft 75 is rotatably supported, extending to the segment gear 73 from the position of the shaft 61. Fixedly mounted on the shaft 75 is a gear 76 which is engaged with the gear 74. On the other end of the shaft 75 is mounted a gear 77 in mesh with the segment gear 73. Upon rotation of the shaft 61 and the gear 74, the shaft 75 is rotated through the bevel gears 74 and 76, and the disk 72 is turned in relation to the eccentric bearing 52 by the gear 77 and the segment gear 73. Links 73 are rotatably supported at their one end on the disk 72 in positions corresponding to the plate cylinder 66. As the disk rotates, the eccentric cam 72 is turned by the link 72 and a lever 79, in accordance with the amount of rotation of the disk 72.

Thus, when the shaft 62 is turned to move the stop screw 60 the eccentric cam 71 is also turned by the disk 72 to change the position of the plate cylinder 66 relative to the position of the rubber blanket cylinder 53, thereby maintaining a constant pressure between the rubber blanket cylinder 53 and the plate cylinder 66.

The plate cylinders 66 differ in the phase of eccentricity from each other, whereby, when the rubber blanket 53 rotates eccentrically, the printing pressure of all of the plate cylinders 66 relative to the rubber blanket 53 can be maintained at a constant value.

Next, the manual adjustment mechanism of the eccentric cams will be explained. As shown in FIG. 3, an eccentric sleeve 80 is rotatably supported in the frame. In this sleeve 80 is rotatably supported the shaft section 71*b* of the eccentric cam 71. A shaft 81 is rotatably mounted through the frames 51, and a gear 82 in mesh with a gear section 80*a* of the gear sleeve 80 is fixedly mounted on the shaft 81.

As the shaft 81 is turned, the sleeve 80 is rotated by the gear 82 and the gear section 80*a*, thus changing the position of the cam section 71*a* of the eccentric cam 71. Since the sleeve 80 and the eccentric cam 71 are designed to be relatively rotatable, an angular movement of the lever 79 is not transmitted to the shaft 81.

The positions of the plate cylinders 66 can thus be individually adjusted by changing the positions of the eccentric cams 71.

Next, the manner of operation of the printing pressure adjusting apparatus will be explained.

When the fluid pressure cylinder 54 operates to extend the piston rod 55, the eccentric bearing 52 is turned to apply printing pressure to the blanket cylinder 53, thus performing a printing operation. The flange section 52*a* of the eccentric bearing 52 contacts the stop 60 to restrict the amount of angular movement of the eccentric bearing 52, thereby maintaining a constant printing pressure notwitstanding the thickness of the sheet.

The purpose of the fluid pressure cylidner 54 is to move the rubber blanket cylinders 53 into contact with, and away from, each other (during printing, the rubber blanket cylinders 53 are fed into contact with ech other, that is, the printing pressure is applied; and when no printing is done, the rubber blanket cylinders 53 are moved away from each other). The adjustment of the printing pressure is determined by the permitted amounmt of revolution of the eccentric bearing 52. This similarly applies to the cylinders 66, as will now be described.

When the cylinder 69 is operated, the piston rod 70 is actuated to turn the eccentric bearing 67, and accordingly the eccentric position of the plate cylinder 66 moves to apply the printing pressure between the plate cylinder 66 and the rubber blanket cylinder 53, thus transferring an image form a printing plate of the plate cylinder 66 to a rubber blanket surface.

When the flange section 67*a* of the eccentric bearing 67 contacts the cam section 71*a* of the eccentric cam 71, preventing further revolution of the eccentric bearing 67.

The angular position of the eccentric bearing 567 can be adjusted by turning the shaft 81 which in turn rotates the gear sleeve 80 to change the position of the cam section 71*a* of the eccentric cam 71.

The eccentric position of the rubber blanket cylinder 53 can similarly be adjusted by turning the shaft 61, which then moves the stop screw 60 in the axial direction to change the position of contact of the flange section 52*a* of the eccentric bearing 52.

When the shaft 61 is turned, the disk 72 is turned through the bevel gears 74 and 76, the gear 77 and the segment gear 73, thereby rotating the eccentric cam 71 by means of the link 78 and the lever 79. Thus, the amount of rotation of the eccentric bearing 67 is adjusted in accordance with the amount of movement of the stop screw 60, and the eccentric position of the plate cylinder 66 is changed with a change in the eccentric position of the rubber blanket 53, keeping a constant printing pressure between the rubber blanket cylinder 53 and the plate cylinder 66.

In the above-described printing pressure adjusting apparatus, the connection of the piston rod 70 of the eccentric bearing 67 and the contact section of the flange section 67*a* of the eccentric bearing 57 which rotates in contact with the cam section 71*a* are situated on the opposite sides across the center of revolution of the eccentric bearing 67. The eccentric bearing 57, therefore, is pressed in one direction against the frame 51, leaving no play therebetween. Therefore, the plate cylinder 66 cannot vibrate or move if it receives the printing pressure intermittently.

Furthermore, when the shaft 51 is turned to adjust the stop screw 60, all of the eccentric cams 71 are adjusted at the same time in accordance with the amount of adjustment of the stop screw 60. Accordingly, when the position of the rubber blanket cylinders 53 is changed, a constant relationship between the rubber blanket cylinders 5 and all of the plate cylinders 66 is maintained without special adjustment of the plate cylinders 66, thereby enabling a constant printing pressure by a simple operation.

In the embodiment described above, the rubber blanket cylinders 53 and the plate cylinders 66 have been explained as the first and second cylinders, but the present invention should not be limited thereto. Also, while the stop screw 60 moving in the axial direction has been shown as the stopper 59 of the eccentric bearing 52, a stop such as an eccentric cam may be used.

The printing pressure adjusting apparatus of the present invention is equipped with an interlock mechanism which simultaneously changes the regulating positions of the stop at the time of adjustment for the purpose of maintaining a constant state of contact between the first and second cylinders.

When, therefore, the amount of eccentricity of the first cylinder has been changed by adjusting the stop, the regulating position of each stop is adjusted by means of the interlock mechanism at the same time in accordance with the amount of stop adjustment, thereby changing the amount of eccentricity of the second cylinder in such a manner that the printing pressure of the first cylinder can be kept constant. In consequence, the printing pressure adjustment can be done with little labor and time, thereby improving operation performance.

The present invention has been described in detail with particular reference to preferred embodiments thereof but it will be understood that variations and modifications can be effected within the spirit and scope of the invention.

What is claimed is:

1. In a printing press of the type having a blanket cylinder and a plurality of plate cylinders rotatable in contact with said blanket cylinder;

means for adjusting the printing pressure of said plate cylinders on said blanket cylinder, said adjusting means comprising:

a frame of said printing press;

an eccentric bearing fitted on said frame and rotatably supporting said blanket cylinder in an eccentric position;

a plurality of eccentric sleeves rotatably supported on said frame and respectively rotatably supporting said plate cylinders in an eccentric position;

stop means for adjustably regulating the angular rotation of said eccentric bearing of said blanket cylinder;

stop means for adjustably regulating the angular rotation of said respective plate cylinders; and an interlock mechanism for maintaining constant the state of contact of said plate cylinders with said blanket cylinder, said interlock mechanism simultaneously changing the position of each said stop means of said respective eccentric sleeves of said plate cylinders in dependence on an adjustment of the angular position of said eccentric bearing of said blanket cylinder.

2. The apparatus of claim 1, including means for adjusting said stop means for adjustably regulating the angular rotation of said eccentric bearing direction of said stop means for adjustably regulating the angular rotation of said eccentric bearing.

3. The apparatus of claim 1, wherein said stop for adjustably regulating the angular rotation of said eccentric bearing means is operative to restrict the extent of angular rotational movement of said eccentric sleeve.

4. The apparatus of claim 1, wherein said interlock mechanism comprises a shaft, the position of angular rotation of said shaft being determined by said stop means for adjustably regulating the angular rotation of said eccentric bearing a disk rotated in unison with said shaft, and linkages extending between said disk and corresponding stop means for adjustably regulating the angular rotation of said respective plate cylinders, rotation of said disk causing adjustment of each of said stop means for adjustably regulating the angular rotation of said respective plate cylinders.

* * * * *